US007828629B2

(12) United States Patent
Tsa

(10) Patent No.: US 7,828,629 B2
(45) Date of Patent: Nov. 9, 2010

(54) KNIFE GRINDER

(75) Inventor: Man Kin Tsa, New Territories (CN)

(73) Assignee: Lico (HK) Manufacturing Ltd., Shatin, New Territories, Hong Kong (CN)

( * ) Notice: Subject to any disclaimer, the term of this patent is extended or adjusted under 35 U.S.C. 154(b) by 0 days.

(21) Appl. No.: 12/322,990

(22) Filed: Feb. 10, 2009

(65) Prior Publication Data

US 2010/0203812 A1 Aug. 12, 2010

(51) Int. Cl.
*B24B 3/54* (2006.01)

(52) U.S. Cl. ..... 451/196; 451/45

(58) Field of Classification Search ..... 451/45, 451/196, 203, 192, 193, 198, 453, 454, 545; 76/87, 86

See application file for complete search history.

(56) References Cited

U.S. PATENT DOCUMENTS 2,432,535 A * 12/1947 McBride ..... 451/194
2,549,529 A * 4/1951 Sandlin ..... 451/453
2,707,852 A * 5/1955 Fillweber ..... 451/192
5,018,310 A * 5/1991 Fierus et al. ..... 451/192
5,377,563 A * 1/1995 Weeks ..... 76/86

* cited by examiner

*Primary Examiner*—Robert Rose
(74) *Attorney, Agent, or Firm*—Alix, Yale & Ristas, LLP

(57) ABSTRACT

A knife grinder comprises a housing, wherein a grinding mechanism is arranged. A magnetic body is arranged under the grinding mechanism to attract metal scraps. Since the magnetic body is arranged under the opening, the knife grinder allows the metal scraps to be fully attracted to the bottom of the housing, thereby maintaining a clean environment during the grinding process.

8 Claims, 5 Drawing Sheets

KNIFE GRINDER

BACKGROUND

1. Field of the Invention

The present invention relates generally to a knife grinder, and more particularly to an improved one which attracts metal scraps during the grinding process.

2. Description of Related Art

An existing knife grinder is generally equipped with a housing, wherein a grinding wheel or a grindstone is arranged for grinding purposes. The grinder is typically driven manually or electrically to rotate of grinding wheel for grinding of the cutting edge. For the purpose of convenient operation, some openings are generally arranged correspondingly onto the housing, and grinding wheels of different sizes are arranged below the openings so as to grind the different cutting edges.

The existing technology can be modified and further developed. One major pitfall of a conventional knife grinder is that the scraps produced during the grinding process will adhere onto the knife grinder, leading to contamination of the operating environment.

SUMMARY

A knife grinder, which is fitted with a collecting mechanism for metal scraps is provided, thus realizing clean operation during the grinding process.

A knife grinder comprises a housing, wherein a grinding mechanism is placed. A magnetic body is arranged under the grinding mechanism to attract the metal scraps after grinding.

The housing is also provided at least with an opening for receiving the cutting edge. The grinding mechanism is a driven grinding wheel that's placed within the housing under the opening.

The grinding mechanism is a grindstone for one embodiment.

The magnetic body is a detachable sliding block, at both sides of which a sliding chute is arranged to mate with an adapting groove at the bottom of the housing.

An embossed pattern may be arranged laterally on the sliding block for easy assembly or disassembly.

Two openings may be arranged on the housing, and two grinding wheels are arranged under every opening.

Two openings may be arranged on the housing, and two grindstones are arranged under every opening.

The opening may be arranged on a portion suspended at one side of the housing. The housing is provided with a support corresponding to the opening.

In summary, a knife grinder is provided wherein a magnetic body is arranged under the opening, so that the metal scraps produced during the grinding process are attracted to the bottom of the housing, thereby maintaining the clean environment during grinding process.

DETAILED DESCRIPTION

The features and the advantages of a knife grinder will be more readily understood from the following detailed description of a preferred embodiment of a knife grinder with reference to the accompanying drawings.

Figure 1A:
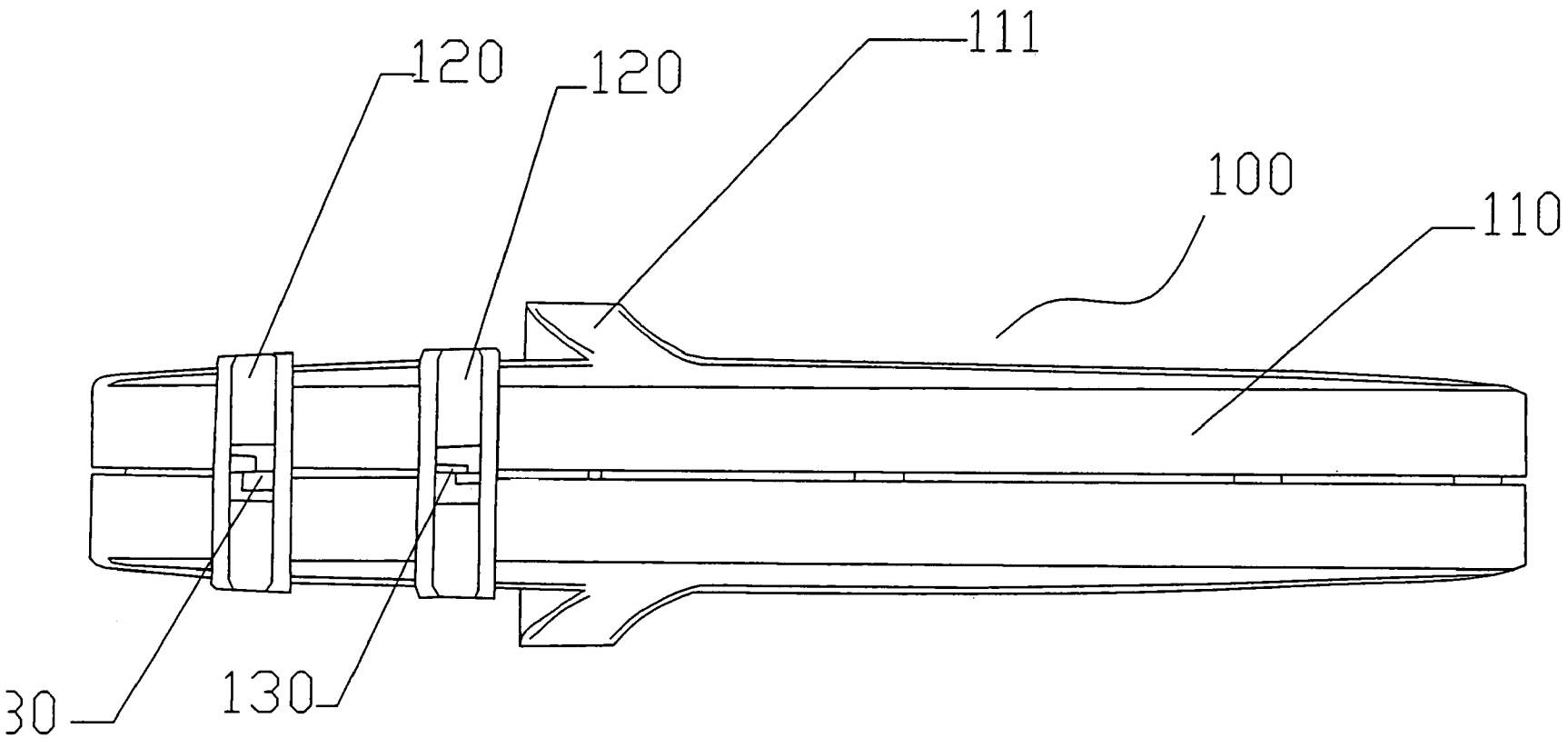
FIGS. 1*a* and 1*b* depict a top view and a front view of a knife grinder.
Figure 1B:
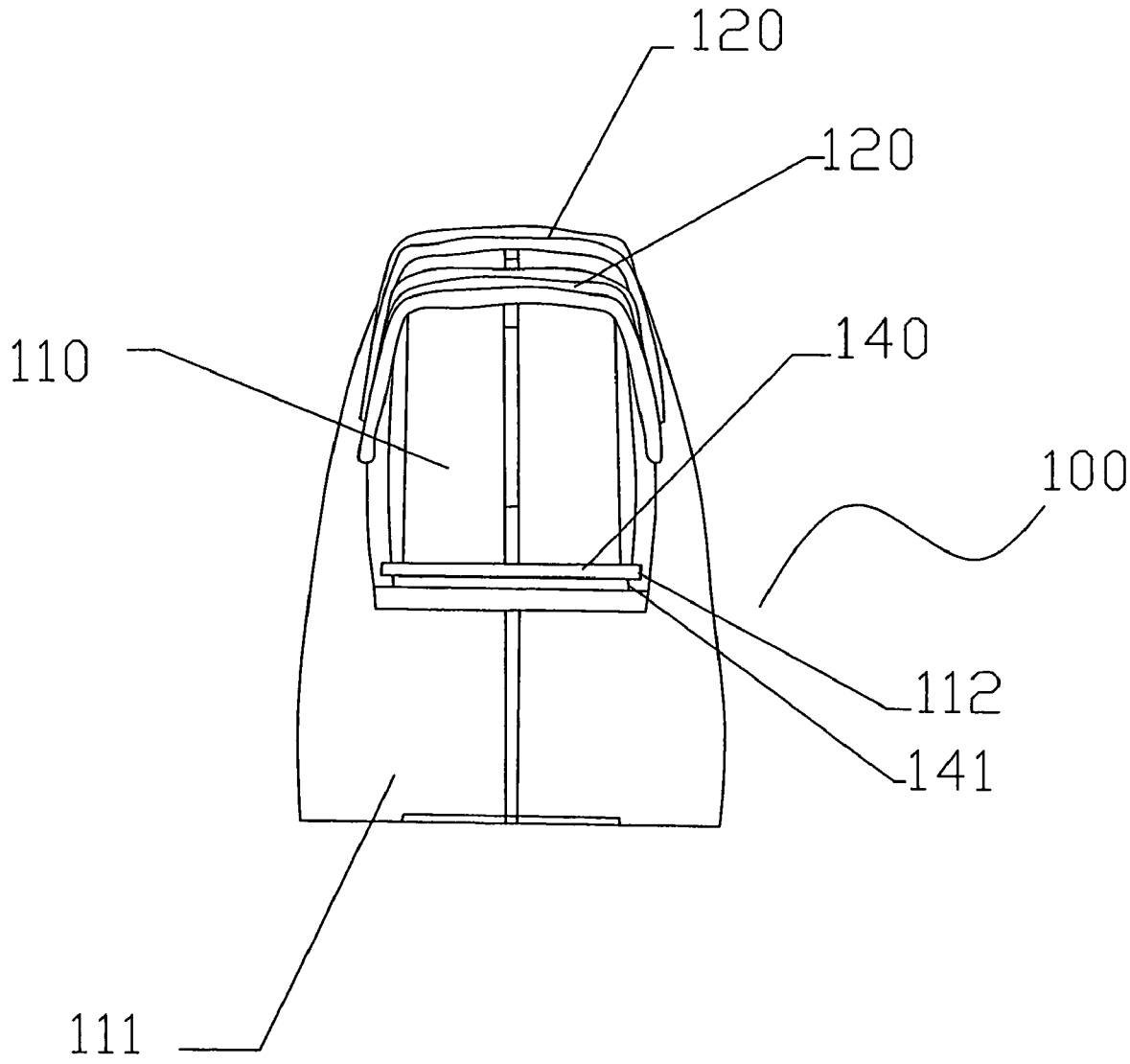
Figure 2:
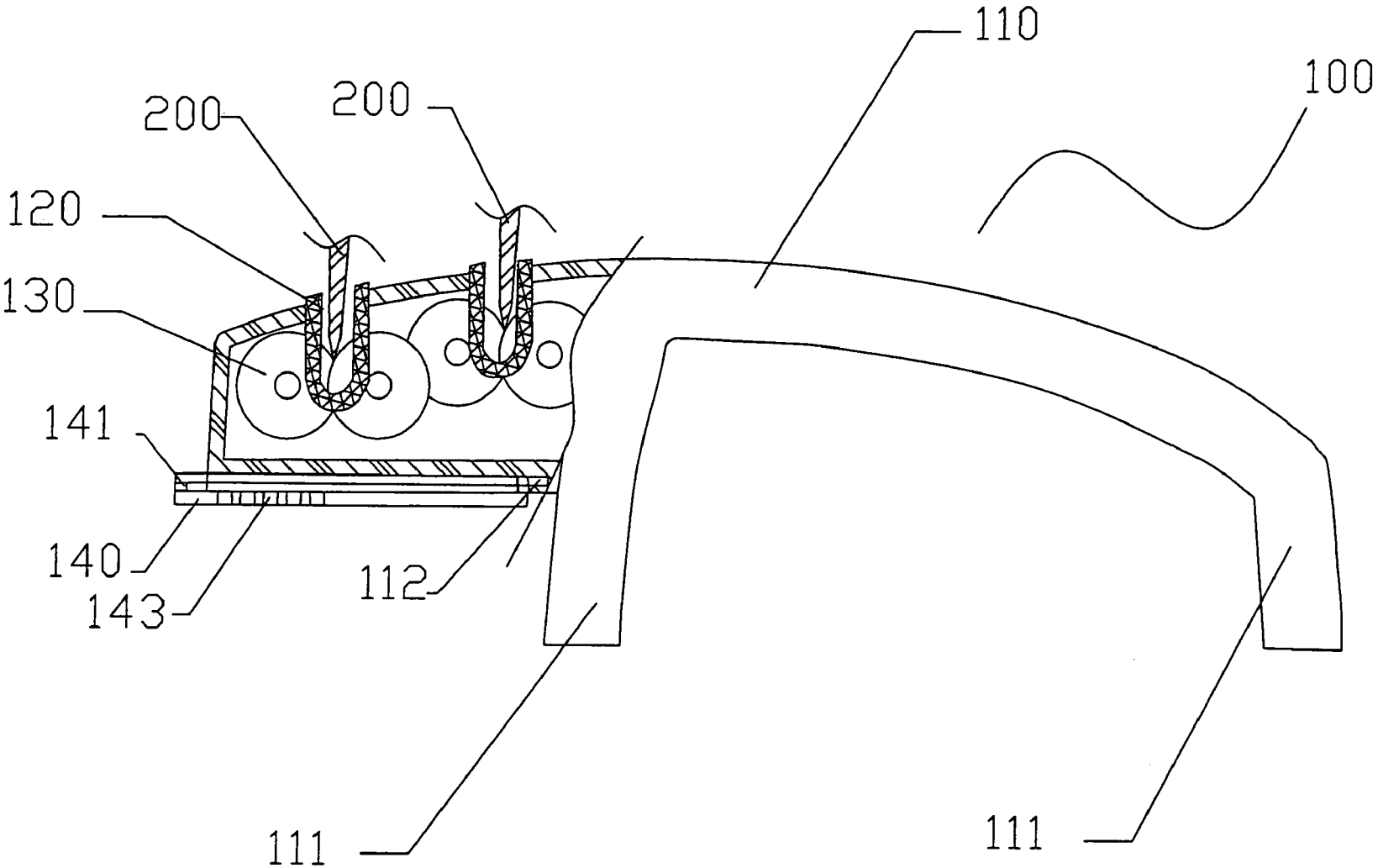
FIG. 2 depicts lateral sectional view of the knife grinder and a pair of knife blade cutting edges partially illustrated in section.
Figure 3A:
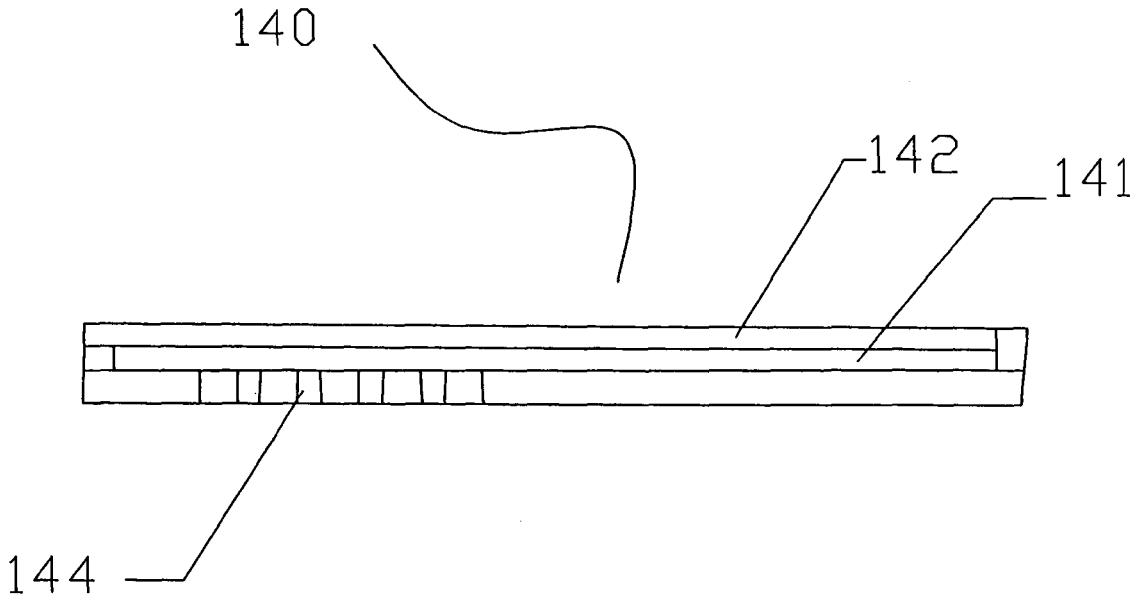
FIGS. 3*a*, 3*b* and 3*c* depict lateral, front and top views of a magnetic body of the knife grinder.
Figure 3B:
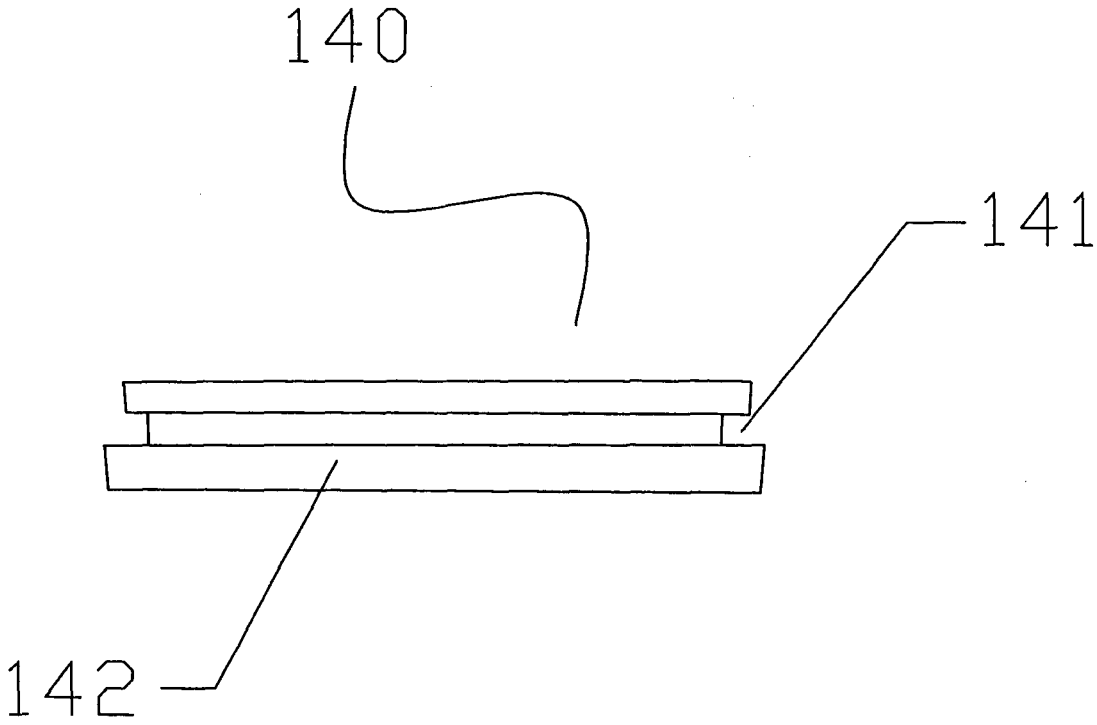
Figure 3C:
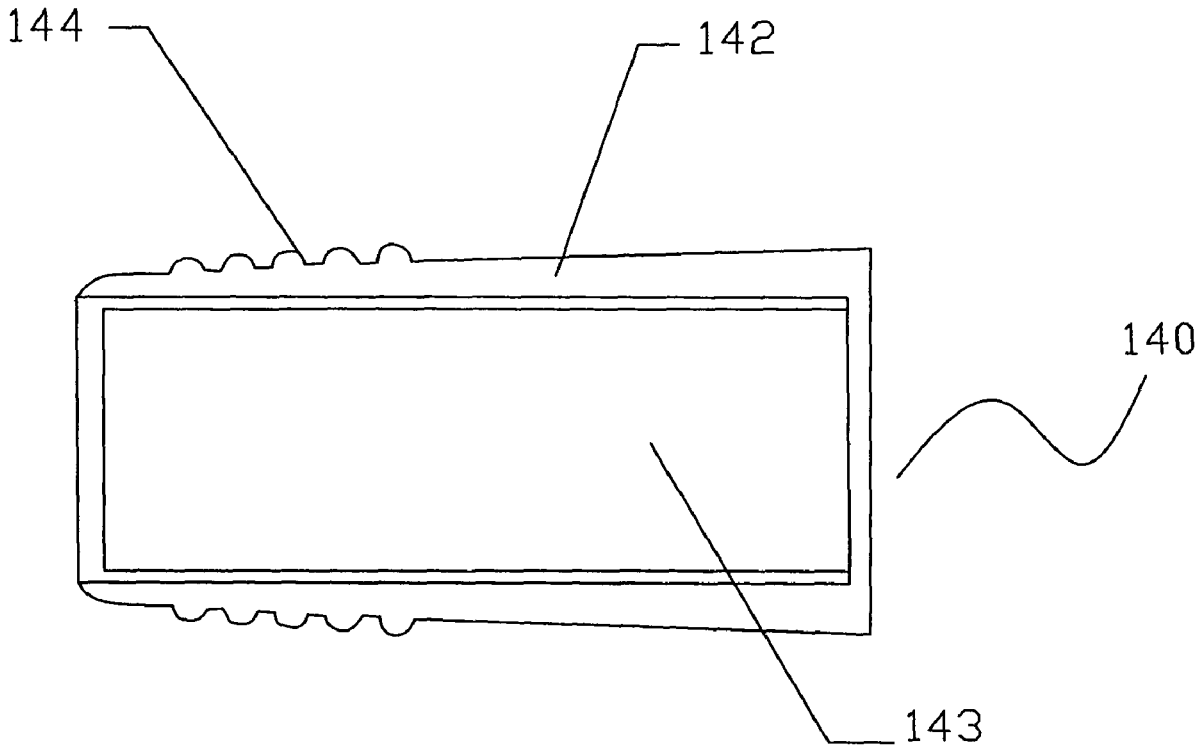

A knife grinder 100 as shown in FIG. 1*a*, 1*b* and FIG. 2, comprises a housing 110, which is made of plastics or metal in any kind of shape. As shown in the preferred embodiment, one end of the housing is overhung or suspended, where opening 120 and grinding wheel 130 are arranged. The other end is provided with a support 111 for standing on the floor or a surface.

The opening 120 on the housing 110 is adapted for receiving the cutting edge 200. Referring to FIG. 2, the number of arranged openings 120 is dependant on the size of the housing 110, e.g. two openings are arranged in this preferred embodiment. In the housing 110 under every opening 120, a driven grinding wheel 130 is arranged as the grinding mechanism. As shown in FIG. 2, two grinding wheels 130 in this preferred embodiment are arranged under every opening 120, and different types of grinding wheels arranged under different openings for grinding of various cutting edges. The grinding mechanism can be configured into other common structures, e.g. grindstone. Moreover, when the grinding wheel is arranged, it can be exposed from the housing without an opening.

In the present knife grinder, as shown in FIG. 2, a magnetic body 140 is also arranged under the grinding wheel 130 so as to attract the metal scraps. The magnetic body 140 is linked to the housing 110 in various ways, e.g. it can be fixed into the housing 10 in advance, or linked permanently to the housing 10 by means of screwing or locking, etc.

In the present knife grinder, as shown in FIG. 2, a magnetic body 140 is also arranged under the grinding wheel 130 so as to attract the metal scraps. The magnetic body 140 is linked to the housing 110 in various ways, e.g. it can be fixed into the housing 110 in advance, or linked permanently to the housing 110 by means of screwing or locking, etc.

The area of the magnetic body 140 is determined by the number of the openings, and multiple magnetic bodies can be arranged on the sliding block to form a bigger attracting area. As for the sliding block, the block housing 142 can also be made of plastics, into which the magnetic material 143 is assembled. For the purpose of easy assembly or disassembly, an embossed pattern 144 is arranged laterally on the sliding block to facilitate manual operation and prevent any slippage during assembly.

In the knife grinder, an opening can also be arranged at the bottom of the housing, and then closed after the magnetic body 140 is assembled. Alternatively, the bottom of the housing can be closed. After the magnetic body 140 is assembled, the metal scraps are attracted onto the side wall at the bottom of the housing 110. After the magnetic body 140 is removed, the metal scraps can be flushed or otherwise disposed on.

Prior to a grinding operation, the sliding chute 141 is mated with the adapting groove 112, and then the magnetic body 140 is assembled onto the housing 110. Next, the grinding is conducted. Then, the magnetic body is removed for disposal of the metal scraps. The knife grinder features simple construction and ease-of-operation while providing a clean environment.

Although the invention has been explained in relation to its preferred embodiment, it is to be understood that many other possible modifications and variations can be made without departing from the spirit and scope of the invention as hereinafter claimed.

The invention claimed is:

1. A knife grinder, comprising:

a housing provided at least with an opening for receiving the cutting edge of a knife and comprising a bottom portion with an adapting groove at a bottom portion of the housing;

a grinding mechanism comprising a driven grinding wheel located in the housing under the opening; and a magnetic body arranged under the grinding mechanism to attract the metal scraps after grinding, said magnetic body comprising a detachable sliding block, at opposing sides of which a sliding chute is arranged to mate with the adapting groove.

2. The knife grinder as claimed in claim 1, wherein the grinding mechanism is a grindstone.

3. The knife grinder as claimed in claim 1, wherein an embossed pattern is configured laterally on the sliding block to facilitate assembly or disassembly.

4. The knife grinder as claimed in claim 2, wherein an embossed pattern is configured laterally on the sliding block to facilitate assembly or disassembly.

5. The knife grinder as claimed in claim 1, wherein two openings are arranged on the housing; and two grinding wheels are arranged under every opening.

6. The knife grinder as claimed in claim 2, wherein two openings are arranged on the housing; and two grindstones are arranged under every opening.

7. The knife grinder as claimed in claim 5, wherein the housing is provided with a support so that a portion of the housing is suspended and each opening is located at the suspended portion of the housing.

8. The knife grinder as claimed in claim 6, wherein the housing is provided with a support so that a portion of the housing is suspended and each opening is located at the suspended portion of the housing.

* * * * *